US009975263B2

(12) United States Patent
Yamamoto

(10) Patent No.: US 9,975,263 B2
(45) Date of Patent: May 22, 2018

(54) SLICER

(71) Applicant: BENRINER CO., LTD, Iwakuni-shi (JP)

(72) Inventor: Hajime Yamamoto, Iwakuni (JP)

(73) Assignee: Benriner Co., LTD, Yamaguchi (JP)

( * ) Notice: Subject to any disclaimer, the term of this patent is extended or adjusted under 35 U.S.C. 154(b) by 3 days.

(21) Appl. No.: 14/886,022

(22) Filed: Oct. 17, 2015

(65) Prior Publication Data

US 2017/0066151 A1 Mar. 9, 2017

(30) Foreign Application Priority Data

Sep. 8, 2015 (JP) ..... 2015-177097

(51) Int. Cl.
*B26D 3/28* (2006.01)

(52) U.S. Cl.
CPC ..... *B26D 3/283* (2013.01); *B26D 2003/286* (2013.01)

(58) Field of Classification Search
CPC ..... B26D 3/283; B26D 2003/086; B26D 7/2628; B26D 1/03; B26D 2001/006; B26D 2007/387; Y10S 83/932; Y10T 83/949; Y10T 83/9488
USPC ..... 30/699.61, 698.11, 856, 857, 858, 440, 30/124, 304; 241/168, 169, 273.1, 285.1, 241/285.2, 101.2
See application file for complete search history.

(56) References Cited

U.S. PATENT DOCUMENTS

| | | | | |
|---|---|---|---|---|
| 2,405,056 | A * | 7/1946 | Rosenbloom | A47J 43/25 241/168 |
| 4,441,254 | A * | 4/1984 | Borner | A47J 43/25 30/124 |
| 4,891,884 | A * | 1/1990 | Torbet | A47J 17/02 30/123.7 |
| 5,680,803 | A * | 10/1997 | Vizurraga | B26B 29/063 83/468.5 |
| 6,082,645 | A * | 7/2000 | Himmighofen | B26D 3/283 241/168 |
| 2008/0257148 | A1 | 10/2008 | Klemm | 83/699.61 |
| 2014/0366699 | A1* | 12/2014 | Wong | B26D 3/283 83/698.11 |
| 2016/0075043 | A1* | 3/2016 | Cotter | B26D 3/185 83/167 |

FOREIGN PATENT DOCUMENTS

| | | |
|---|---|---|
| JP | 2004-338069 | 12/2004 |
| JP | 2011-156435 | 8/2011 |

* cited by examiner

*Primary Examiner* — Ghassem Alie
(74) *Attorney, Agent, or Firm* — Fattibene and Fattibene LLP; Paul A. Fattibene

(57) ABSTRACT

A slicer is provided which slices a slicing subject with a uniform thickness and can be used in a sanitized manner. The slicer includes a resin-made frame which supports both ends of a slicing blade, a resin-made movable support plate attached to the frame so as to be able to ascend and descend, first reinforcing members buried in the frame, a second reinforcing member buried at one end of the movable support member in a width direction, and a third reinforcing member buried at the other end. The first reinforcing members, the second reinforcing member, and the third reinforcing member absorb bending stress acting on the slicer.

6 Claims, 11 Drawing Sheets

SLICER

TECHNICAL FIELD OF THE INVENTION

The present invention relates to slicers which slice a slicing subject such as vegetable and fruit and, in particular, to a slicer capable of arbitrarily adjusting the slicing width of the slicing subject.

BACKGROUND OF THE INVENTION

Conventionally, as a tool for easily slicing a slicing subject such as any of various vegetables and fruits into sliced pieces with any thickness, a slicer has been used which swings the slicing subject forward and backward in a slicing direction to slice the slicing subject with a slicing blade.

A conventional slicer in related art includes a frame having paired left and right support arms, a slicing blade fixed at both ends to the support arms, a fixed support plate placed at the front of the slicing blade and bridging between paired left and right frame parts, and a movable support plate placed at the back of the slicing blade. By moving the movable support plate in a vertical direction, the slicing width (thickness) of the slicing subject can be adjusted.

The movable support plate of the slicer as described above is supported by a sliding support body placed below the movable support plate and, by moving the sliding support body forward and backward to change a support position, the movable support plate can ascend or descend in a vertical direction (for example, refer to Japanese National Publication No. 2010-524574, corresponding to International Patent Application Publication WO 2008/130812 and United States Patent Application Publication 2008/0257128).

However, in the slicer as described above, with the slicing subject swung forward and backward as being pressed onto the movable support plate, the slicer tends to warp when the slicing subject is sliced. Therefore, a space (actual slicing width) between the slicing blade and the movable support plate is widened more than a space (initially-set slicing width) between the slicing blade and the movable support plate set in advance, thereby possibly causing the slicing subject to be sliced thicker than an intended thickness.

Moreover, passages where both ends of the sliding support body are accommodated are small. In these passages, fine chips of the slicing subject may be caught or dirty water containing mud attached onto the surface of the slicing subject and so forth may remain, thereby possibly impairing sanitary conditions as the slicer is used over a long period of time.

Thus arises a technical problem to be solved in order to provide a slicer which slices a slicing subject with a uniform thickness and can be used in a sanitized manner, and an object of the present invention is to solve this problem.

SUMMARY OF THE INVENTION

The present invention is suggested to achieve the object described above. A first aspect of the present invention provides a slicer which slides a slicing subject in a slicing direction and slices the slicing subject with a slicing blade, the slicer including: a frame made of resin, the frame supporting both ends of the slicing blade; a movable support plate made of resin and attached to the frame so as to be able to ascend and descend, the movable support plate supporting the slicing subject; and a reinforcing member made of metal and buried in the frame or the movable support plate, the reinforcing member which absorbs bending stress acting on the slicer when the slicing subject is sliced.

According to the structure of the first aspect, the metal-made reinforcing member absorbs bending stress acting on the frame or the movable support plate due to pressing force at the time of slicing, thereby inhibiting warping of the frame or the movable support plate and retaining the previously-set space between the slicing blade and the movable support plate. Therefore, the slicing subject can be sliced with a desired thickness.

Also, with the reinforcing member buried in the slicer, it is possible to easily wash chips, dirty water, and so forth away even if they are attached. Therefore, the slicer can be used in a sanitized manner.

A second aspect of the present invention provides a slicer in which, in addition to the structure of the slicer according to the first aspect, the reinforcing member is provided in the movable support plate over the slicing direction.

According to the structure of the second aspect, since the reinforcing member is placed in the movable support plate along the slicing direction, the reinforcing member absorbs bending stress acting on the movable support plate over the entire movable support plate, thereby inhibiting warping of the movable support plate. Therefore, the slicing subject can be sliced with a desired thickness.

A third aspect of the present invention provides a slicer in which, in addition to the structure of the slicer according to the first aspect, the movable support plate is formed in a trapezoidal shape in a planar view, and the reinforcing member is placed along a long side of the movable support plate.

According to the structure of the third aspect, with the reinforcing member placed along the long side of the movable support plate, the reinforcing member reinforces the long side of the movable support plate, where bending stress tends to concentrate, thereby inhibiting warping of the movable support plate. Therefore, the slicing subject can be sliced with a desired thickness.

A fourth aspect of the present invention provides a slicer in which, in addition to the structure of the slicer according to the first aspect, the movable support plate includes a tip support part formed in a bow shape in a planar view, and the reinforcing member is placed along an edge of the tip support part.

According to the structure of the fourth aspect, with the reinforcing member placed along the edge of the tip support part, the reinforcing member reinforces the tip support part, where bending stress tends to concentrate, thereby inhibiting warping of the movable support plate. Therefore, the slicing subject can be sliced with a desired thickness.

A fifth aspect of the present invention provides a slicer in which, in addition to the structure of the slicer according to any one of the first to fourth aspects, the reinforcing member is provided in the frame over the slicing direction.

According to the structure of the fifth aspect, with the reinforcing member placed in the frame over the slicing direction, the reinforcing member absorbs bending stress acting on the frame over the entire frame, thereby inhibiting warping of the frame. Therefore, the slicing subject can be sliced with a desired thickness.

In the slicer according to the present invention, the metal-made reinforcing member absorbs bending stress acting on the frame or the movable support plate, thereby inhibiting warping of the frame or the movable support plate and retaining the previously-set space between the slicing blade and the movable support plate. Therefore, the slicing subject can be sliced with a desired thickness.

Also, with the reinforcing member buried in the slicer, it is possible to easily wash chips, dirty water, and so forth away even if they are attached. Therefore, the slicer can be used in a sanitized manner.

BRIEF DESCRIPTIONS OF THE DRAWINGS

Figure 8A:
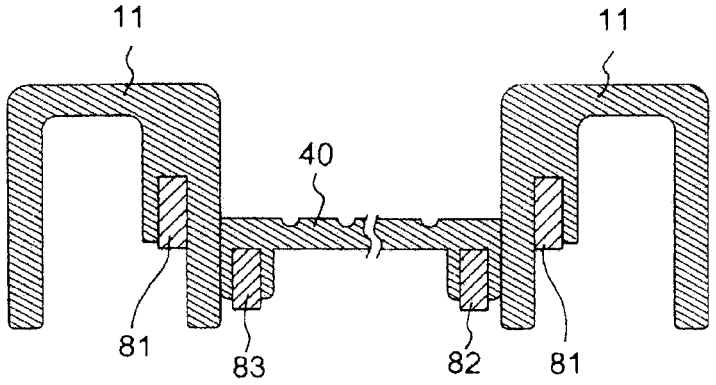
Figure 8B:
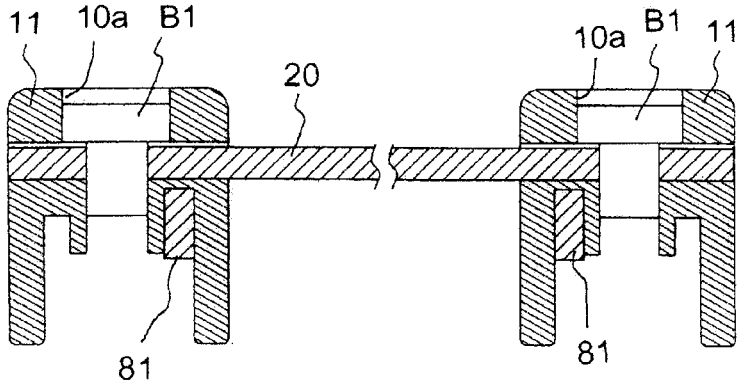
Figure 8C:
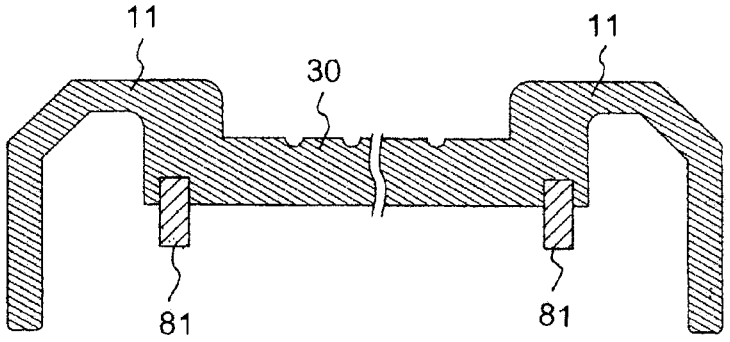
Figure 9:
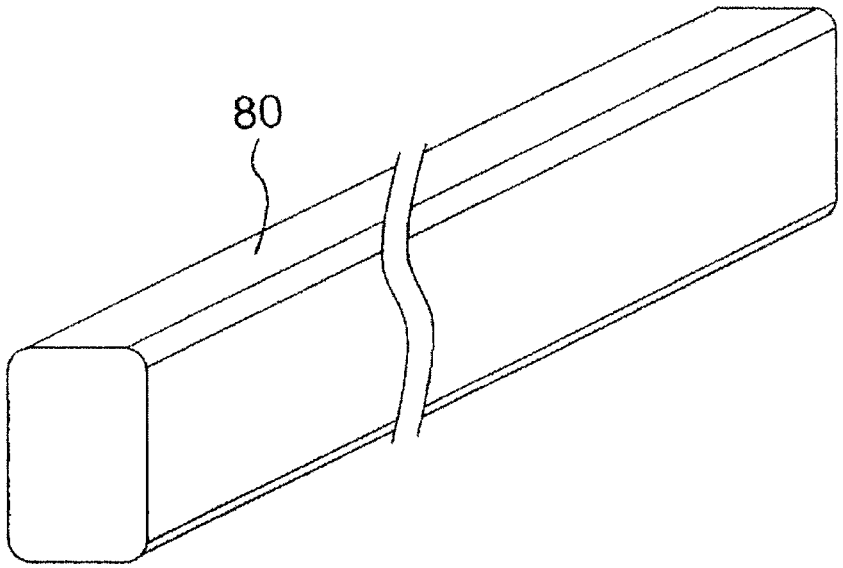
Figure 10A:
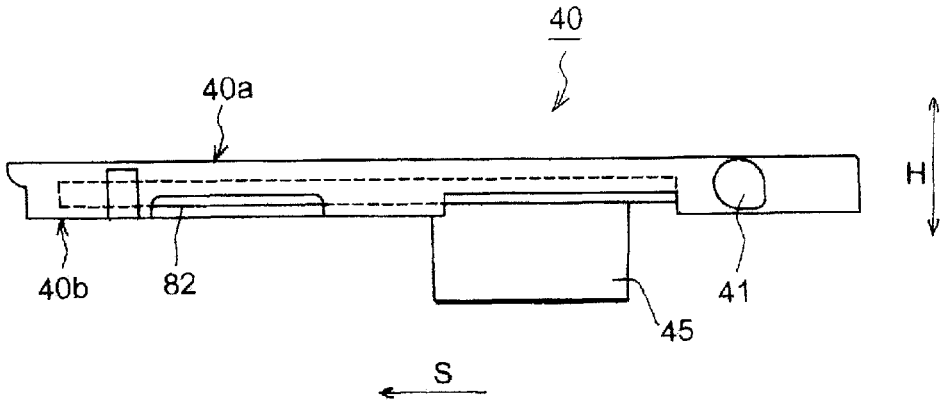
Figure 10B:
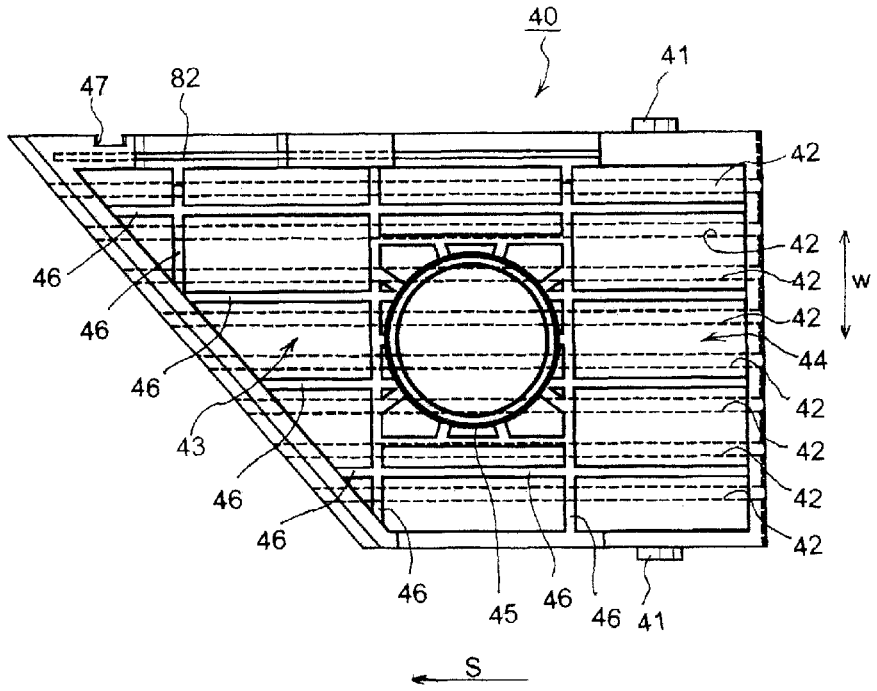
Figure 11A:
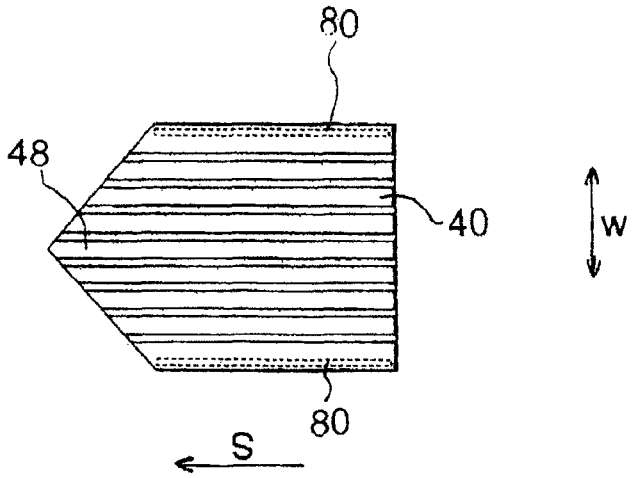
Figure 11B:
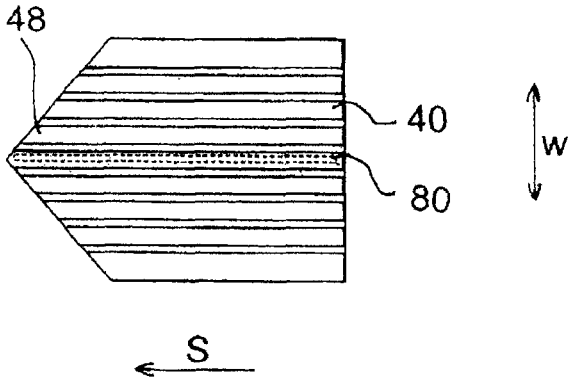
Figure 11C:
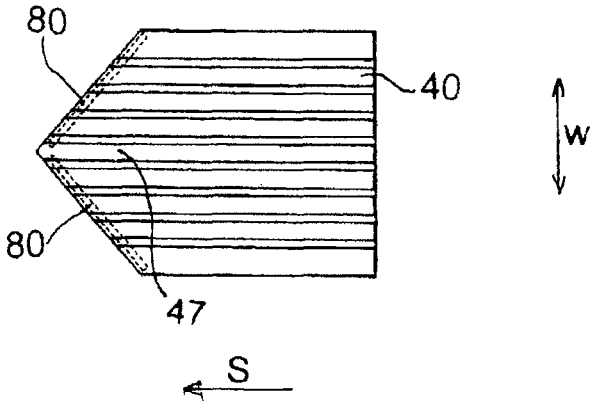

FIGS. 8A, 8B, and 8C are partially-omitted substantially longitudinal end face views of burial positions of a first reinforcing member, a second reinforcing member, and a third reinforcing member;

FIG. 9 is a partially-omitted substantially perspective view of the reinforcing member;

FIG. 10A is a front view of a movable support plate for use in a slicer according to a first modification example of the present invention;

FIG. 10B is a bottom view of the movable support plate depicted in FIG. 10A; and FIGS. 11A, 11B, and 11C are schematic views of movable support plates for use in a slicer according to a second modification example of the present invention.

DESCRIPTIONS OF THE PREFERRED EMBODIMENTS

In order to achieve an object of providing a slicer which slices a slicing subject with a uniform thickness and can be used in a sanitized manner, the present invention is achieved by providing a slicer which slides a slicing subject in a slicing direction and slices the slicing subject with a slicing blade, the slicer including: a frame made of resin, the frame supporting both ends of the slicing blade; a movable support plate made of resin and attached to the frame so as to be able to ascend and descend, the movable support plate supporting the slicing subject; and a reinforcing member made of metal and buried in the frame or the movable support plate, the reinforcing member which absorbs bending stress acting on the slicer when the slicing subject is sliced.

Figure 1:
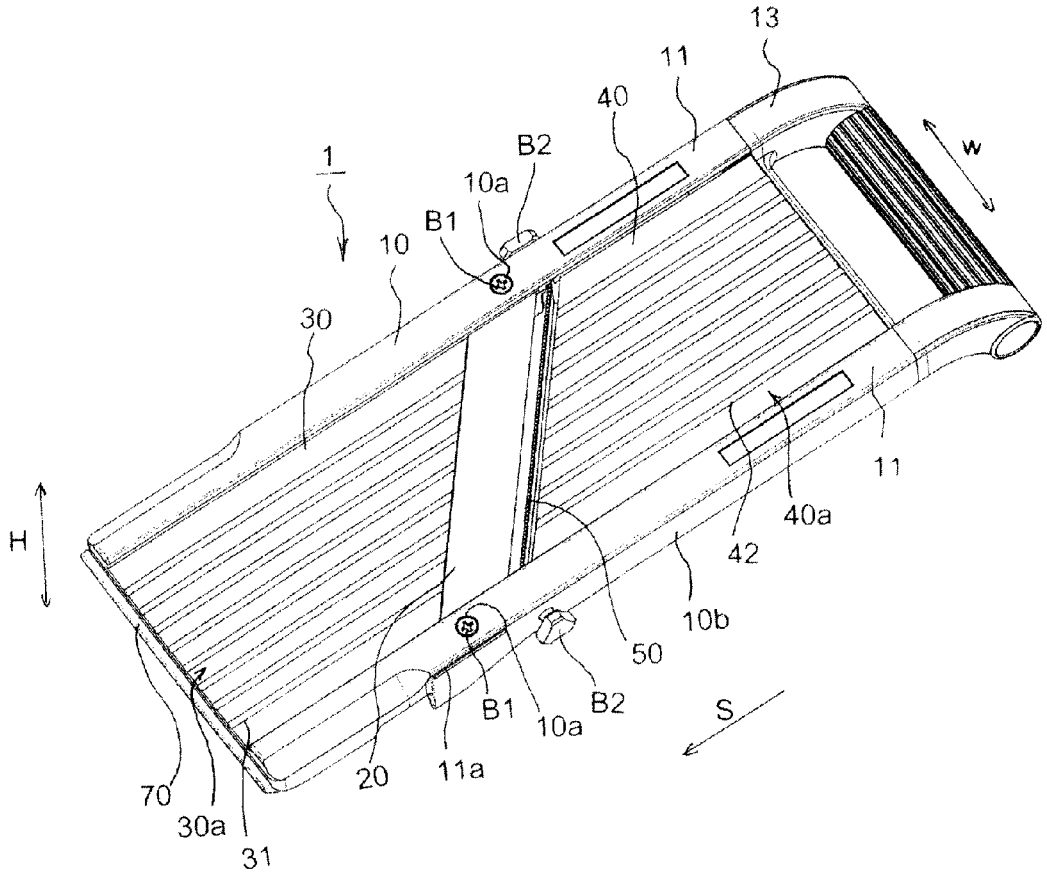
FIG. 1 is a perspective view of a slicer on a front side according to one embodiment of the present invention.
Figure 2:
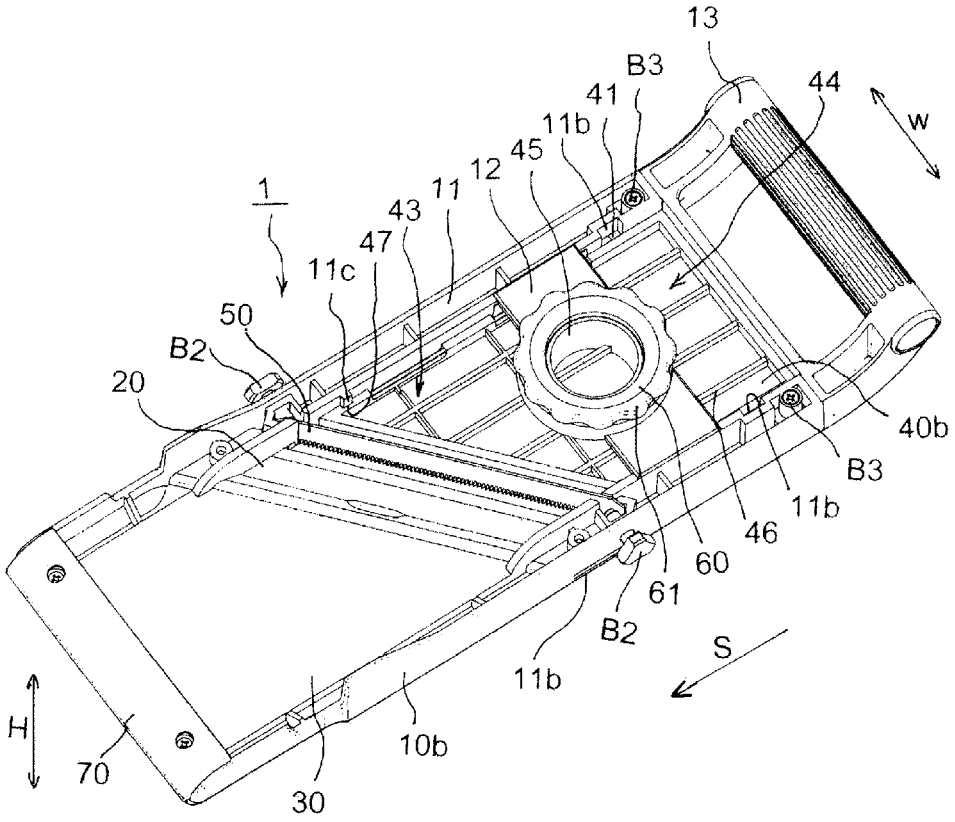
FIG. 2 is a perspective of the slicer of FIG. 1 on a back side.
Figure 3:
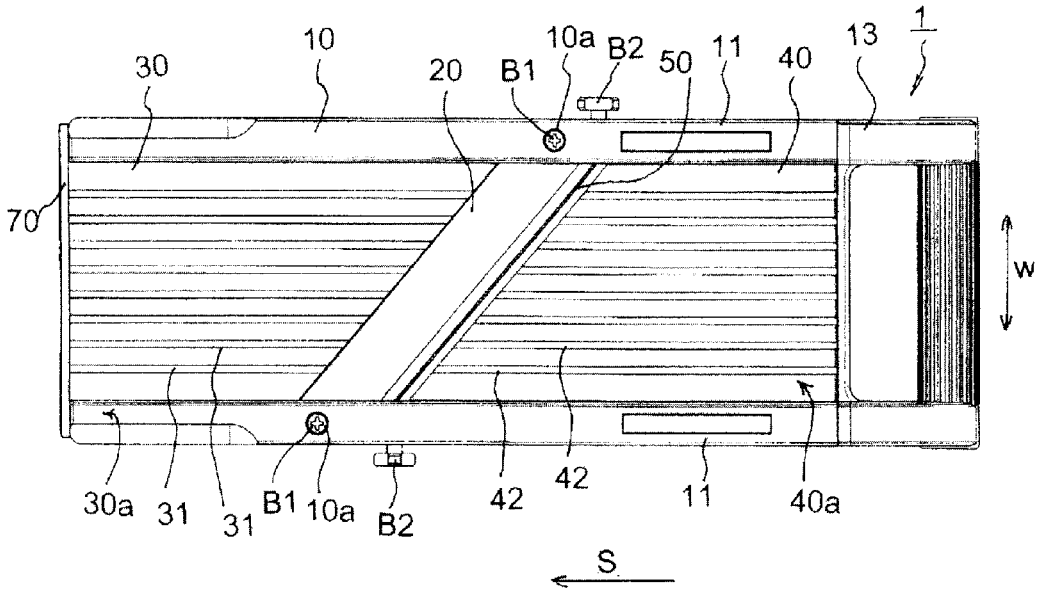
FIG. 3 is a plan view of the slicer of FIG. 1.
Figure 4:
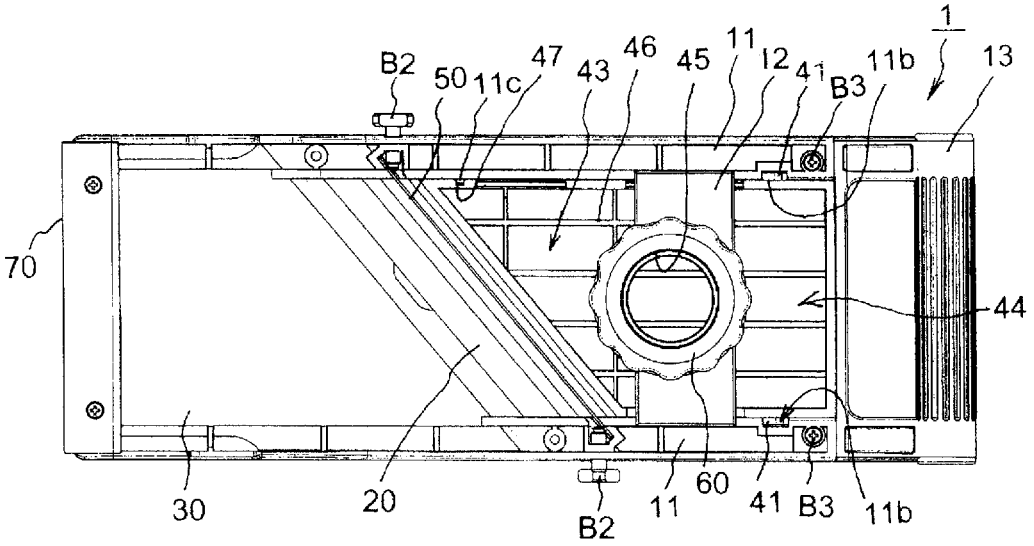
FIG. 4 is a bottom view of the slicer of FIG. 1.
Figure 5:
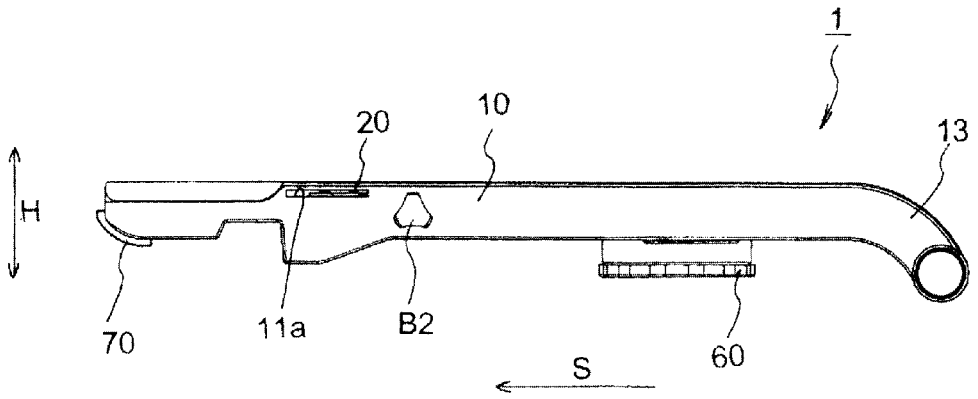
FIG. 5 is a front view of the slicer of FIG. 1.
Figure 6:
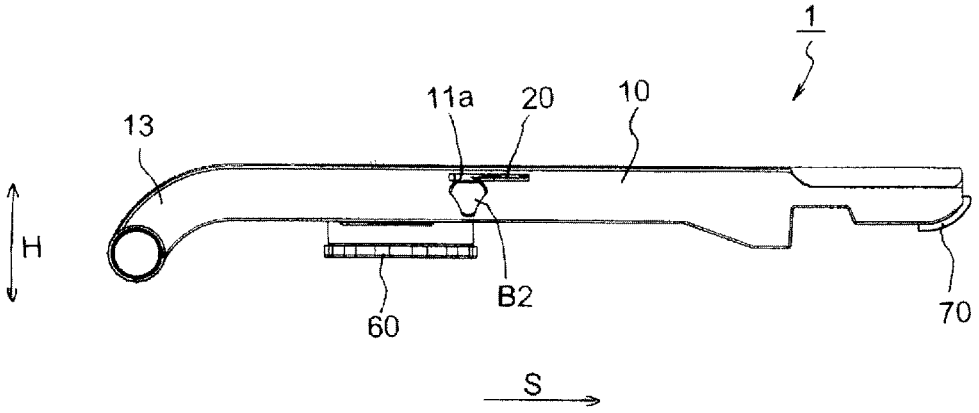
FIG. 6 is a back view of the slicer of FIG. 1.

A slicer 1 according to one embodiment of the present invention is described below based on the drawings. FIG. 1 is a perspective view of the slicer 1 on a front side. FIG. 2 is a perspective view of the slicer 1 on a back side. FIG. 3 is a plan view of the slicer 1. FIG. 4 is a bottom view of the slicer 1. FIG. 5 is a front view of the slicer 1. FIG. 6 is a back view of the slicer 1. In the following, terms "front" and "back" correspond to frontward and backward in a slicing direction S which matches a direction of sending a slicing subject when the slicing subject is sliced. Also, terms "above" and "below" correspond to upward and downward of the slicer in a vertical direction H.

The slicer 1 includes a frame 10, a slicing blade 20 which slices a slicing subject, a fixed support plate 30 placed forward of the slicing blade 20, a movable support plate 40 placed backward of the slicing blade 20, a replaceable blade 50, and a slicing-width adjusting dial 60 which supports the movable support plate 40. The frame 10, the fixed support plate 30, the movable support plate 40, and the slicing-width adjusting dial 60 are each made of ABS resin and manufactured by injection molding. The slicing blade 20 and the replaceable blade 50 are made of stainless steel.

With the user swinging the slicing subject in the slicing direction S while pressing the slicing subject onto the movable support plate 40, the slicer 1 slices the slicing subject into sliced pieces with a thickness corresponding to a space between the slicing blade 20 and the movable support plate 40. The sliced pieces are discharged from the back side of the slicer 1.

The slicing blade 20 diagonally extends with respect to a width direction W of the frame 10. On the left and right of the slicing blade 20, holes not depicted are bored. The slicing blade 20 is fastened to the frame 10 with bolts B1 each inserted into a mount hole 10*a* provided to the surface of the frame 10 and one hole of the slicing blade 20. The slicing blade 20 is not restricted to be fastened to the frame 10 with the bolts as long as the slicing blade 20 can be fixed to the frame 10.

The replaceable blade 50 is attached between the slicing blade 20 and the movable support plate 40. The replaceable blade 50 has both ends supported by the frame 10. The replaceable blade 50 is provided with a plurality of tooth over a longitudinal direction of the replaceable blade 50, and can give incision to the slicing subject along the slicing direction S in accordance with a space between the teeth. The replaceable blade 50 is fixed by being pressed onto the frame 10 with bolts B2 inserted from bolt insertion holes, not depicted, formed in outer side surfaces 10*b* of the frame 10. By combining the slicing blade 20 and the replaceable blade 50 together for use, the slicing subject can be sliced into sticks or straps with various sizes.

The movable support plate 40 and the slicing-width adjusting dial 60 are removably attached to the frame 10, and each member can be individually cleaned.

The slicer 1 includes a non-slip member 70 attached to the tip in the slicing direction S. On a front surface of the non-slip member 70, a non-slip layer made of resin is provided. The non-slip member 70 has a ridgeline cross-sectional shape in the slicing direction S curved in a convex shape. When the user uses the slicer 1, the non-slip member 70 is diagonally pressed onto a cutting board or the like, thereby allowing the slicing subject to be sliced without slipping of the slicer 1.

The frame 10 includes paired left and right support arms 11 attached to both ends of the fixed support plate 30 in the width direction and a stay 12 bridging between the paired left and right support arms 11.

The support arms 11 include slits 11*a* provided to inner side surfaces to accommodate both ends of the slicing blade 20. The slicing blade 20 is inserted from the slits 11*a* to be placed at a predetermined position.

The support arms 11 have inner side surfaces provided with guide grooves 11*b* recessed therein. The guide grooves 11*b* are provided to extend along a vertical direction H. The guide grooves 11*b* are configured to engage with guided pins 41, which will be described further below, of the movable support plate 40. Each guide groove 11*b* can be set to have any shape. Since a lower part of the guide groove 11*b* in the vertical direction H is formed so as to be open, the movable support plate 40 is attachable to and removable from the frame 10.

The frame 10 includes a grip 13 to be held by the user. The grip 13 may be removably fastened to the frame 10 with bolts B3.

The fixed support plate 30 is placed between the paired support arms 11, and is integrally attached to the support arms 11. In a front surface 30*a* of the fixed support plate 30, groove parts 31 are inscribed in eight rows, extending in the slicing direction S and provided in parallel with each other in the width direction W. With the groove parts 31 provided on the front surface 30*a* of the fixed support plate 30, the fixed support plate 30 and the slicing subject are in contact with each other in a reduced area, thereby allowing the slicing subject to smoothly swing. The groove parts 31 can be set to have any depth dimension.

The movable support plate 40 includes guided pins 41 provided to project from side surfaces on the back. The guided pins 41 are engaged with the guide grooves 11*b* of the support arms 11, and the movable support plate 40 ascends and descends in accordance with the shape of the guide grooves 11*b*. For example, when the guide grooves 11*b* extend upward from below and are formed diagonally forward from the back in the slicing direction S, the movable support plate 40 also diagonally ascends and descends in accordance with the shape of the guide grooves 11*b*. When the movable support plate 40 ascends, the guided pins 41 are engaged with the guide grooves 11*b*, thereby regulating wobbling and twist of the movable support plate 40.

The movable support plate 40 includes groove parts 42 inscribed in a front surface 40*a* in eight rows, extending in the slicing direction S and provided in parallel with each other in the width direction W. Since the contact area between the movable support plate 40 and the slicing subject is reduced by the area of the groove parts 42, sliding friction occurring when the slicing subject is sliced is reduced.

The movable support plate 40 is formed in a trapezoidal shape projecting forward in the slicing direction S in a planar view. A tip part 43 of the movable support plate 40 is formed so as to be gradually narrowed from a portion near the center of the movable support plate 40 toward the front in the slicing direction S.

Also, on a back surface 40*b* of the movable support plate 40, a first rib 45 is disposed. The first rib 45 is formed in a tapered shape gradually expanding in diameter upward from below in the vertical direction H, allowing the movable support plate 40 to be easily removed from a mold. While the first rib 45 is formed in a hollow cylindrical shape in the present embodiment, the first rib 45 can be formed in any shape as long as the stiffness of the movable support plate 40 is increased. For example, the first rib 45 may be formed in a solid cylindrical shape or an elliptic cylindrical shape.

On the back surface 40*b* of the movable support plate 40, second ribs 46 placed in a lattice shape are provided, which can further increase the stiffness of the movable support plate 40.

The slicing-width adjusting dial 60 is formed in a hollow cylindrical shape, and has an end part provided with a handle 61. On the outer perimeter of the slicing-width adjusting dial 60, a screw part is provided. With the screw part screwed into a screw receiving hole, not depicted, provided at the center of the stay 12, the slicing-width adjusting dial 60 is attached to the frame 10. The slicing-width adjusting dial 60 is formed so as to have a diameter larger than the outer diameter of the first rib 45. With the slicing-width adjusting dial 60 relatively ascending and descending with respect to the frame 10 as supporting the movable support plate 40, the movable support plate 40 can ascend and descend in the vertical direction H.

Also, the movable support plate 40 includes a guide groove 47 provided forward of a side surface so as to be recessed. With the guide groove 47 engaged with a guided part 11*c* provided to project from the inner side surface of the support arm 11, the movable support plate 40 stably ascends and descends.

Figure 7:
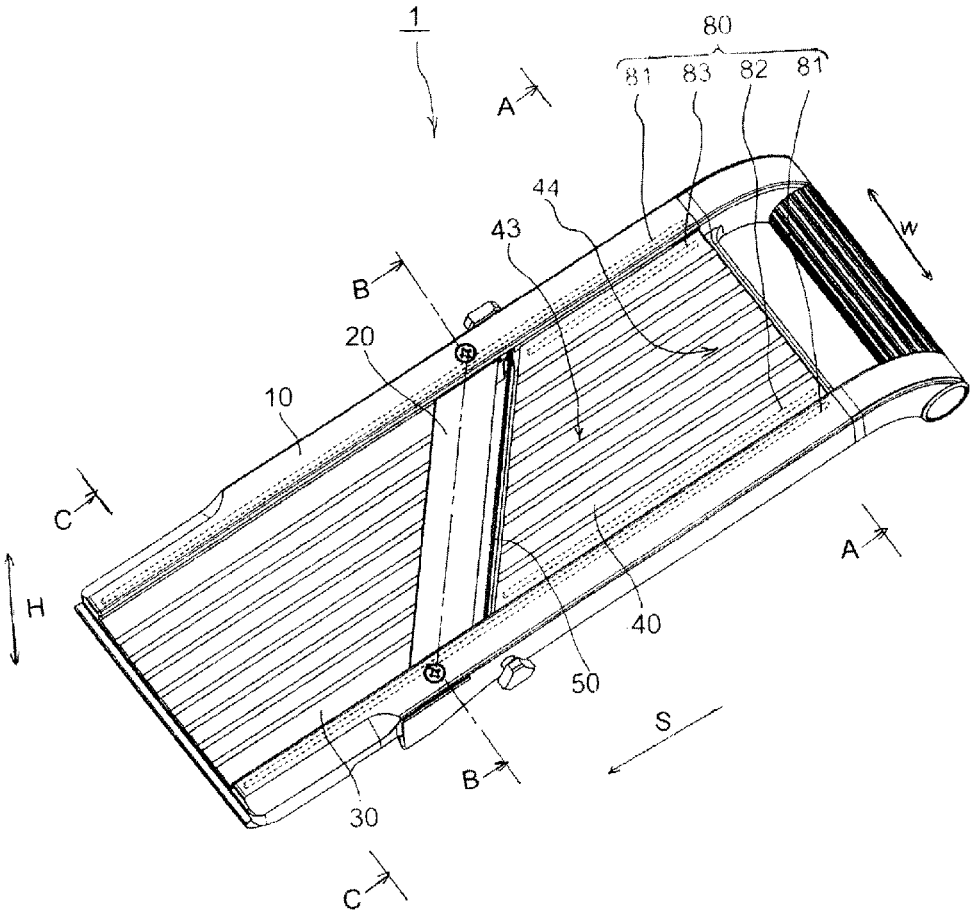
FIG. 7 is a schematic view of positions where reinforcing members buried in the slicer are placed.

Next, reinforcing members 80 buried in the slicer 1 are described based on the drawings. FIG. 7 is a schematic view of positions where the reinforcing members buried in the slicer 1 are placed. FIG. 8A is a partially-omitted substantially longitudinal end face view viewed along an A-A line of FIG. 7. FIG. 8B is a partially-omitted substantially longitudinal end face view viewed along a B-B line of FIG. 7. FIG. 8C is a partially-omitted substantially longitudinal end face view viewed along a C-C line of FIG. 7.

The reinforcing members 80 made of metal are buried in the frame 10. The reinforcing members 80 are for example, made of stainless steel, iron, or the like, configured to include, two first reinforcing members 81 buried in the frame 10 and a second reinforcing member 82 and a third reinforcing member 83 buried in the movable support plate 40.

The first reinforcing members 81 extend along the slicing direction S from a tip of the frame 10 to a back end thereof so as to each pass through the support arm 11. The first reinforcing members 81 are each placed above the slit 11*a* and inside the mount hole 10*a*. The first reinforcing members 81 are inserted into the mold and buried in the frame 10 when the frame 10 is formed by injection molding.

The second reinforcing member 82 is formed in a stick shape with a rectangular cross section, and is placed along a long side of the movable support plate 40 from the tip part 43 to a back end part 44. The third reinforcing member 83 is formed in a short stick shape with a rectangular cross section, and is placed along a short side of the movable support plate 40 from the tip part 43 to the back end part 44. Specifically, the second reinforcing member 82 and the third reinforcing member 83 are accommodated between the front surface 40*a* and the back surface 40*b* of the movable support plate 40. When the movable support plate 40 is formed by injection molding, the second reinforcing member 82 and the third reinforcing member 83 are inserted into a mold and buried in the movable support plate 40. The first reinforcing members 81, the second reinforcing member 82, and the third reinforcing member 83 are not restricted to each have a rectangular cross section, and each may have, for example, a circular cross section. When the first reinforcing members 81, the second reinforcing member 82, and the third reinforcing member 83 are formed so as to have a rectangular cross section with each corner chamfered as depicted in FIG. 9, each of these reinforcing members can be easily inserted into an angular mold. When the first reinforcing members 81, the second reinforcing member 82, and the third reinforcing member 83 are formed so as to have a circular cross section, the strength of each reinforcing member can be enhanced.

The reinforcing members 80 may be any length as long as the reinforcing members 80 absorb bending stress acting on the slicer 1 to inhibit warping of the frame 10 and/or the movable support plate 40. The reinforcing members 80 are not required to be provided to each of the frame 10 and the movable support plate 40, but may be provided to either one of these. Also, either one of the second reinforcing member 82 and the third reinforcing member 83 will suffice. However, as depicted in FIG. 10A and FIG. 10B, with provision of the second reinforcing member 82, it is possible to reinforce the long side portion of the movable support plate 40, where warping tends to occur. In FIG. 10A, the groove parts 42 and so forth are omitted for easy understanding of the second reinforcing member 82.

Also, the reinforcing members 80 are preferably installed at a location where bending stress acting on the slicer 1 concentrates. For example, the location of installation may be changed as appropriate in accordance with the shape of the movable support plate 40. When the movable support plate 40 includes a tip support part 48 formed in a bow shape in a planar view as depicted in FIG. 11A to FIG. 11C, reinforcing members 80 of the same size may be buried at both ends in the width direction W as depicted in FIG. 11A, one reinforcing member 80 may be buried at the center in the width direction W so as to go across the tip support part 48 as depicted in FIG. 11B, or two reinforcing members 80 may be buried along the edge of the tip support part 48.

In this manner, in the slicer 1 according to the present invention, the reinforcing members 80 made of metal absorb bending stress acting on the frame 10 or the movable support plate 40 due to pressing force at the time of slicing, thereby inhibiting warping of the frame 10 or the movable support plate 40 and retaining the previously-set space between the slicing blade 20 and the movable support plate 40. Therefore, the slicing subject can be sliced with a desired thickness.

Also, with the reinforcing members 80 buried in the slicer 1, it is possible to easily wash chips, dirty water, and so forth away even if they are attached. Therefore, the slicer 1 can be used in a sanitized manner.

Note that the present invention can be variously modified as long as such modifications do not deviate from the spirit of the present invention, and it goes without saying that such modifications are included in the present invention.

What is claimed is:

1. A slicer which slides a slicing subject in a slicing direction and slices the slicing subject with a slicing blade, the slicer comprising:

a frame made of resin, the frame supporting both ends of the slicing blade;

a movable support plate made of resin having longitudinal sides and attached to the frame so as to be able to ascend and descend, the movable support plate having a top planar surface facing the slicing blade supporting the slicing subject; and a reinforcing member made of metal and buried entirely below the top planar surface and extending parallel to the longitudinal sides over an entire length of said movable support plate and parallel to the slicing direction of the movable support plate, the reinforcing member which absorbs bending stress acting on the slicer when the slicing subject is sliced.

2. The slicer according to claim 1, wherein the movable support plate is formed in a trapezoidal shape in a planar view.

3. The slicer according to claim 1, wherein the movable support plate includes a tip support part formed in a bow shape in a planar view.

4. The slicer according to claim 1, wherein another reinforcing member is provided in the frame over the slicing direction.

5. A slicer which slides a slicing subject in a slicing direction and slices the slicing subject with a slicing blade, the slicer comprising:

a frame made of resin, said frame supporting both ends of the slicing blade and having longitudinal support arms;

a movable support plate made of resin having longitudinal sides parallel to the longitudinal support arms of said frame and attached to said frame so as to be able to ascend and descend, said movable support plate having a top planar surface facing the slicing blade supporting the slicing subject; and a reinforcing member made of metal and buried entirely below the top planar surface and extending parallel to the longitudinal sides of said movable support plate over an entire length of said movable support plate and parallel to the slicing direction of said movable support plate, said reinforcing member having a shape and cross section of a size sufficient to absorb bending stress acting on said movable support plate preventing bending of said movable support plate when the slicing subject is sliced.

6. A slicer as in claim 5 wherein:

the cross section of said reinforcing member is a rectangle with a longest cross section dimension perpendicular to the top planar surface of said movable support plate.

* * * * *